US012534287B1

(12) United States Patent
Dos Santos

(10) Patent No.: US 12,534,287 B1
(45) Date of Patent: Jan. 27, 2026

(54) DISASSEMBLE AND CONFIGURABLE MODULAR CONTAINER

(71) Applicant: PETRÓLEO BRASILEIRO S.A.—PETROBRAS, Rio de Janeiro (BR)

(72) Inventor: Roque Adenilson Ferreira Dos Santos, Rio de Janeiro (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 39 days.

(21) Appl. No.: 18/393,256

(22) Filed: Dec. 21, 2023

(30) Foreign Application Priority Data

Dec. 25, 2022 (BR) ..... 1020220265909

(51) Int. Cl.

| | |
|---|---|
| ***B65D 88/00*** | (2006.01) |
| ***B65D 88/12*** | (2006.01) |
| ***B65D 90/00*** | (2006.01) |
| ***B65D 90/02*** | (2019.01) |

(52) U.S. Cl.
CPC ..... *B65D 88/005* (2013.01); *B65D 88/12* (2013.01); *B65D 90/0026* (2013.01); *B65D 90/023* (2013.01)

(58) Field of Classification Search
CPC ..... B62B 3/027; B65D 1/225; B65D 7/24; B65D 9/12; B65D 88/005; B65D 88/12; B65D 90/0026; B65D 90/023
See application file for complete search history.

(56) References Cited

U.S. PATENT DOCUMENTS

| | | | | |
|---|---|---|---|---|
| 3,966,075 A * | 6/1976 | Schultz | B65D 88/025 | 220/8 |
| 5,538,178 A * | 7/1996 | Zink | B65D 19/06 | 493/115 |
| 6,076,690 A * | 6/2000 | Hemmerly | B65D 19/16 | 217/65 |
| 6,460,724 B1 * | 10/2002 | Bradford | B65D 5/0055 | 220/6 |
| 6,533,122 B1 * | 3/2003 | Plunkett | B65D 77/061 | 220/826 |
| 6,547,127 B2 * | 4/2003 | Bradford | B65D 21/0213 | 229/199 |

(Continued)

*Primary Examiner* — Kareen K Thomas
(74) *Attorney, Agent, or Firm* — Kilpatrick Townsend & Stockton LLP

(57) ABSTRACT

The present invention refers to a disassemble and configurable modular container for strategic areas that have the potential for using space of oil platforms. The disassemble and configurable modular container of the present application is made of plates that allow expansion and variation in height due to the vertical sliding feature, in addition to changing its configuration through fitting crossheads, without the need to use a crane for mobilizing the container in the unit, as it can be easily assembled/disassembled by two employees. Furthermore, the detachable and configurable modular container as described herein, is molded to the layout of the environment available due to its height adjustment and configuration variation (single piece or "L", "T" or "U" shaped), and hence, it overcomes the difficulties that aerial interference, such as lines, gutters and pipes from equipment and structures inherent to the site, can cause.

17 Claims, 7 Drawing Sheets

(56) References Cited

U.S. PATENT DOCUMENTS

| | | | | |
|---|---|---|---|---|
| 6,808,074 | B1 * | 10/2004 | Schwartz | A47B 47/0041<br>312/265.5 |
| 7,984,819 | B1 * | 7/2011 | Davis | B65D 88/524<br>220/4.28 |
| 9,278,802 | B2 * | 3/2016 | Huang | B65D 88/528 |
| 2001/0007307 | A1 * | 7/2001 | Karpisek | B65D 25/56<br>206/386 |
| 2006/0011625 | A1 * | 1/2006 | Arnold | B65D 19/18<br>220/6 |
| 2009/0261093 | A1 * | 10/2009 | Fullerton | B25H 3/021<br>220/4.28 |

* cited by examiner

DISASSEMBLE AND CONFIGURABLE MODULAR CONTAINER

FIELD OF THE INVENTION

The present invention falls within the technical field of oil and gas, more specifically, it is related to the field of vessels, platforms, probes and production facilities, more specifically, it refers to a disassemble and configurable modular container for strategic areas with the potential for use of space of the platforms.

BACKGROUND OF THE INVENTION

Currently, a container applied to installations such as FPSO are known to present small variations between shipowners, but, in general, they have two basic dimensions following the international standards: sizes of 20 and 40 feet. Simply put, 20' shipping containers are between 5 and 6 meters long and between 2 and 2.5 meters wide and high. The 40' ones are twice as long, ranging from 11 to 12 meters.

Due to this static and rigid configuration of the container available in the market, it is difficult to move it in environments located in the deck, topside and hood areas of an oil platform, for example, either due to the impossibility of moving it with a crane or due to interference (structures, piping, pressurized lines, equipment, and so on) caused by the installation layout.

Accordingly, failure to use strategic storage locations in sheltered areas occurs since the traditional arrangement (assemblies of cables and equipment, process lines, etc.) of a sea unit imposes limitations that make it impractical, both laterally and in height, to install a conventional container, since this unique structure has weight and sizes that make it unfeasible to mobilize it for entry/exit, or bringing this resource closer to the location of interest.

Accordingly, the difficulty in mobility brings loss of yield and ergonomics, due to repetitive movements towards distant storage stations, poor organization and cleaning with improvised storage points, creation of storage locations using scaffolding, which brings additional rental costs.

In this sense, in view of the limitations of the state of the art, the present invention solves the impossibility of installing a traditional container in a free space located in a sheltered area of an oil platform due to the difficulty in moving it due to the aforementioned issues. Precisely, the container described herein can be installed in any sheltered space on the oil platform (deck, topside and hood) or uncovered space in the unit.

Therefore, the use of a disassemble and configurable modular container proves to be an interesting alternative to solving the limiting issues of the state of the art, since the proposed disassemble and configurable modular containers are structures made of modular plates that can be disassembled and provide for expansion and variation in height due to a vertical sliding feature, in addition to changing their configuration through fitting crossheads.

In view of this, and in order to solve the described technical problems, the present previously invention does not require the use of a for mobilization because both transport to destination and assembly of the container can be easily carried out by two employees, for example.

STATE OF THE ART

There exist disassemble and configurable containers in the prior art, however, the prior art containers have deficiencies when compared to the modular container of the present invention, as no prior art container can be disassembled and configured, which a feature is achieved by the presence of crossheads and potential for vertical adjustment (height), if required.

U.S. Pat. No. 5,413,236A, for example, describes a modular shipping container for use in shipping cargo for facilitating the loading of cargo by conventional truck trailers. The container includes a floor element, a plurality of upstanding frame members which are positioned about the floor element, and a plurality of wall panels.

However, the present invention differs from document U.S. Pat. No. 5,413,236A primarily because it is directed at cargo shipping, while the present invention is applied to storage of material, human occupation, remote warehouse, support workshop, strategic warehouse, office and kiosk. Secondly, the container in U.S. Pat. No. 5,413,236A has modular plates that fit into frames, its expansion occurs by horizontally increasing the number of containers and the height increases via vertical increments in the plates, which is only possible to assemble in an "I" shape. Contrary to U.S. Pat. No. 5,413,236A, the present invention has 90° and connection crossheads that enable the horizontal expansion of the container space via such connection crossheads and configuring the arrangement layout via 90° crossheads, in addition to the height being adjustable between 1.80 m and 2.20 m, according to the project's demands, and the assembly can be made in "I", "L", "U" and "T" shapes.

In turn, document EP1182149A2 describes a dismountable modular container because its submultiple sizes are proportional to the standardized sizes of known containers; dismountable to form a package with its structural components to be reshipped to origin; and able to be coupled to form units of a greater capacity and stackable.

However, the present invention differs from document EP1182149A2, primarily because it is aimed at cargo shipping as does U.S. Pat. No. 5,413,236A. Secondly, the container of document EP1182149A2 has modular plates that fit into profiles, it is extended through horizontally extending the space, the height does not change and it has an "I" shaped assembly.

U.S. Pat. No. 3,386,600A covers demountable shipping containers and more particularly, a demountable height-adjustable gondola that is adapted to accommodate uncrated cargo, such as jeeps and ambulances, as well as smaller container units.

The present invention differs from U.S. Pat. No. 3,386,600A as it is also directed at cargo shipping, in addition to having a modular assembly and demountable gondola. It is understood that it is extended by horizontally adjusting the space and its height is adjustable with only the "I"-shaped assembly being possible, as also disclosed in the other previously mentioned documents.

Document GB2376014A is part of the general state of the art and describes a folding platform base container or flatrack, with inset folding corner posts and attendant outboard end bracing frames, which is configured for outward splay, for overhead loading or unloading and provides compact collapse folding of both posts and bracing frames upon a platform base.

Document GB2376014A features pivot hinge adjustment while the present invention features modular plates that fit into 90° and connecting crossheads. Also, document GB2376014A does not have the ability to adjust the container height and it is extended through horizontally adjusting the space, without using connecting crossheads, as in the present invention.

Finally, U.S. Pat. No. 3,401,814A describes a foldable shipping container having a base structure that supports a decking panel, which in turn supports elongated corner posts releasably positioned to limit peripheral corner walls extending vertically from the base structure. The base structure includes channels for supporting side panels which abut flange members of the corner posts and which are detachably connected thereto, and which together support in releasable engagement a roof structure having downwardly extending limited walls. forming a roof channel.

Therefore, the container of U.S. Pat. No. 3,401,814A is foldable without using 90 degree- and connecting-crossheads, as in the present invention, and it is extended by horizontally adjusting the space using no connecting crossheads, as in the container of the present invention.

BRIEF DESCRIPTION OF THE INVENTION

The present invention refers to a disassemble and configurable modular container that comprises a structure of disassemble modular plates, which allow expansion and variation in height due to the vertical sliding feature, in addition to changing the container configuration via fitting crossheads comprising at least one upper closure plate, connecting crossheads that perform the horizontal expansion of the container space, at least one naval wooden plate for the floor, 90° crossheads that set the container arrangement layout, at least one metal plate for side closure; and slides for adjusting the side closure plate.

In the preferred embodiment described herein, the container comprises a marking system made on its tubes to adjust the container height, preferably between 1.80 m and 2.20 m; wherein the container further comprises a system for adjusting the side plates so that they can be adjusted to the possible height variations, the container being molded to the layout of the environment available as it can be adjusted in height and its configuration can be changed by the 90° crossheads.

Furthermore, in the preferred embodiment of the invention, the crosshead of the crosshead system is a piece of stainless steel (AISI 316) made using high-resistance laser cutting, which closes the floors and ceilings of the container while allows its layout to change according to the container's adjustment needs in relation to its width, length and change in shape.

BRIEF DESCRIPTION OF THE FIGURES

In order to complement the present description and provide a better understanding of the features of the present invention, and in accordance with a preferred embodiment of the present invention, a set of figures is attached herein, which represents, in an exemplary although not limiting manner, the preferred embodiment of the present invention.

DETAILED DESCRIPTION OF THE INVENTION

The present invention refers to a disassemble and configurable modular container (3) for strategic areas that have the potential for using space of oil platforms. The disassemble and configurable modular container (3) of the present application is made of plates that allow expansion and variation in height due to the vertical sliding feature, in addition to changing its configuration through fitting crossheads, without the need to use a crane for mobilizing the container in the unit, as it can be easily assembled/disassembled by, for example, two employees in an average time of 120 minutes. Furthermore, the disassemble and configurable modular container (3), described herein can be molded into the layout of the available environment due to its height adjustment variation in configuration (a single piece or "L", "T" or "U" shaped), and hence it overcomes the difficulties that aerial interference, such as lines, gutters and pipes of equipment and structures inherent to the site can cause.

Figure 7:
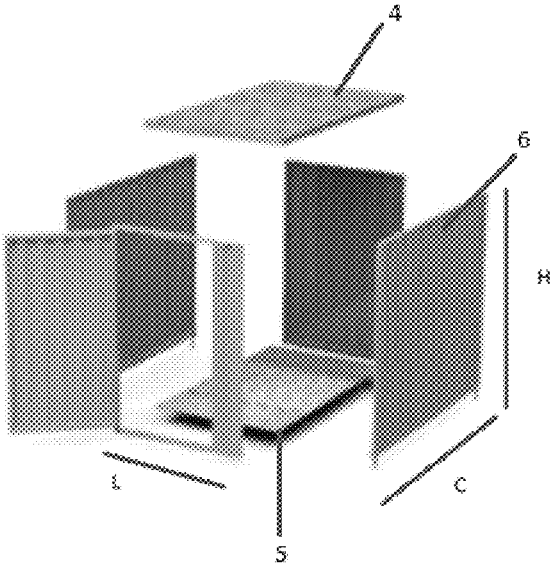
FIG. 7 shows the container modules demonstrating that it has standard length, C=2.0 m, width L=3.0 m and height H=2.2 m sizes, but a minimum unit can be created having different sizes, in addition to being made up of a plate for upper closure (4), a straight crosshead for expansion, a naval wooden plate for flooring (5), a 90 degree crosshead (1) for configuration, a metal sheet for side closure (6) and a slide for adjusting the side closure plate, according to a preferred embodiment of the present invention.
Figure 8:
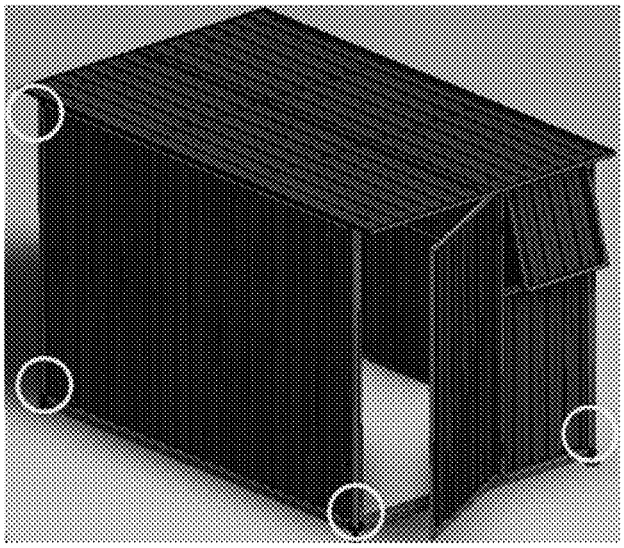
FIG. 8 shows the system of expansion and arrangement change crossheads that makes it possible to change the size and layout configuration of the container, according to a preferred embodiment of the present invention.

Furthermore, as previously discussed, the disassemble and configurable modular container (3) of the present invention can be installed in any sheltered/unsheltered space of the unit, as it has a modular deposit, as seen in FIG. 7, which provides a basic unit of standard sizes: L=2.0 m×W=3.0 m×H=2.2 m and approximately 250 kg, however a minimum unit can be created with the following sizes: L=1.0 m×W=7.50 m×H=2.2 m. Therefore, the latter specification would be the main condition for application. In other words, with the exception of this minimum size limitation, there is no need to modify the original installation of the structures, machinery and/or lines/pipes, since the resource is intended to be adapted to the environment. Furthermore, such modularity makes it easy for two employees to assemble/disassemble it within an average time of 120 minutes. Such speed is due to the crosshead system, as shown in FIG. 8.

As seen in FIG. 7, the disassemble and configurable modular container (3) of the present invention comprises at least one upper closure plate (4), a straight crosshead for expansion, a naval wooden floor plate (5), a 90-degree crosshead (1) for configuration, a metal sheet for side closure (6) and a slide for adjusting the side closure plate.

Figure 6:
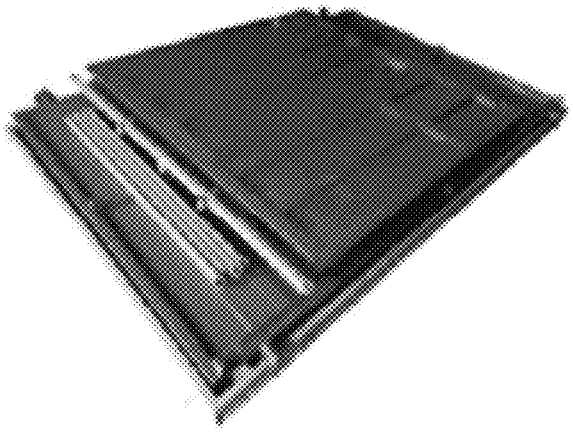
FIG. 6 shows a view of the container (3) disassembled, showing that it comprises disassemble modular plates with side and top closure features with Galvalume steel sheet, in accordance with a preferred embodiment of the present invention.

According to what is shown in FIG. 6, which represents a disassembled view of the container (3) of the present invention, it is noted that it comprises a structure made of modular plates that can be disassembled, having profiles preferably manufactured in AISI 304 stainless steel and high resistance steel, both of 1.5 mm in thickness, with chemical treatment against corrosion and weathering.

Furthermore, the disassemble modular container (3) of the present invention has side and top closure features with Galvalume steel sheet (steel having a service life 4 times greater under the same use conditions than galvanized steel. A combination resulting from 55% Aluminum, 43.5% Zinc and 1.5% Silicon).

Furthermore, it is important to highlight that in addition to the advantage of the fast assembly of the disassemble modular container (3) of the present invention, with the connection crosshead system (2) and change of arrangement, it is possible to change the size configuration and layout of the container (3).

Basically, the crosshead of the crosshead system is a stainless-steel part (AISI 316) made using high-resistance laser cutting. Its main function is to close the floors and ceilings of the container (3) while allowing its layout to change according to the adjustment needs of the container (3) in relation to its width, length and change in shape from "square", "U", "I" or "L".

Figure 1:
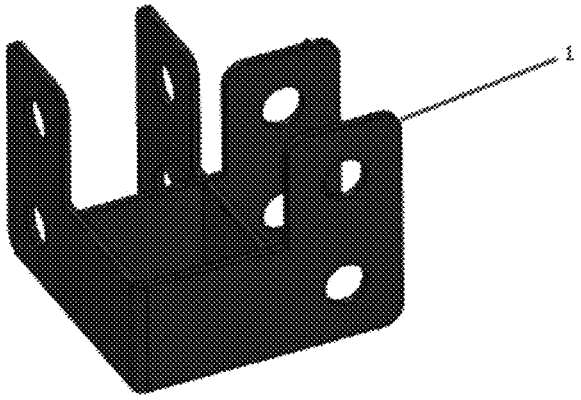
FIG. 1 shows the 90° crosshead (1) of the container, highlighting the fact that it is responsible for changing the container configuration, according to a preferred embodiment of the present invention.
Figure 3:
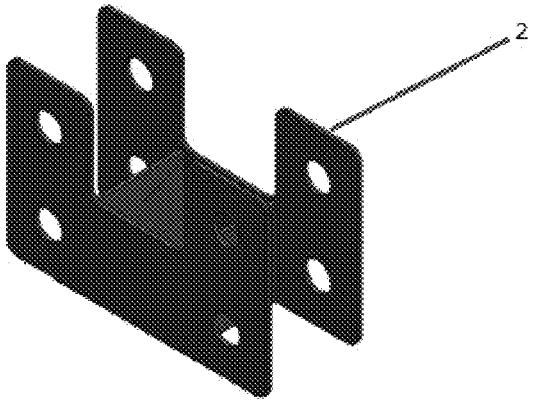
FIG. 3 shows the connection crosshead (2), which enables the feature of varying the size of a unit, according to a preferred embodiment of the present invention.
Figure 4:
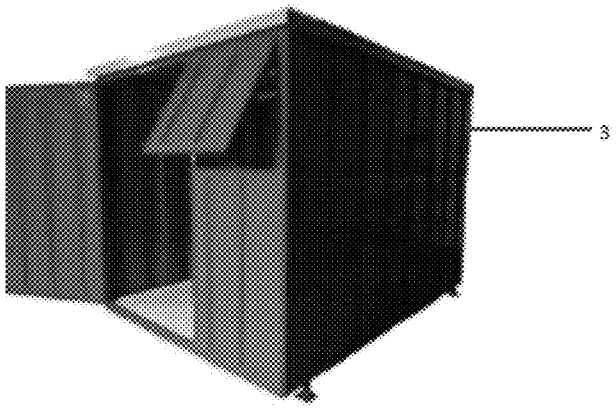
FIG. 4 is a perspective view of the disassemble and configurable modular container (3) of the present invention, demonstrating that it preferably comprises at least one window and one door, according to a preferred embodiment of the present invention.
Figure 5:
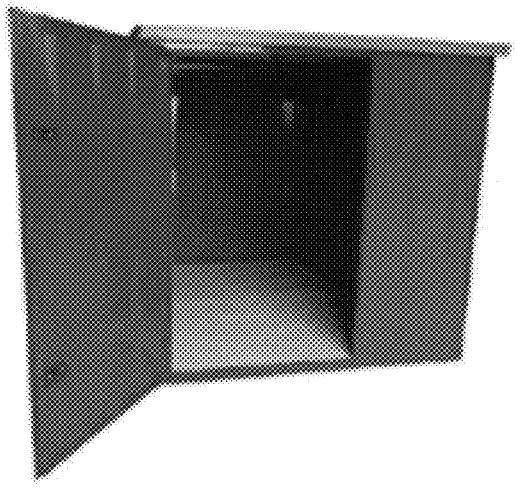
FIG. 5 depicts a front view of the interior of the container (3), demonstrating that it comprises at least one wooden floor plate to a preferred embodiment of the present invention.
Figure 9:
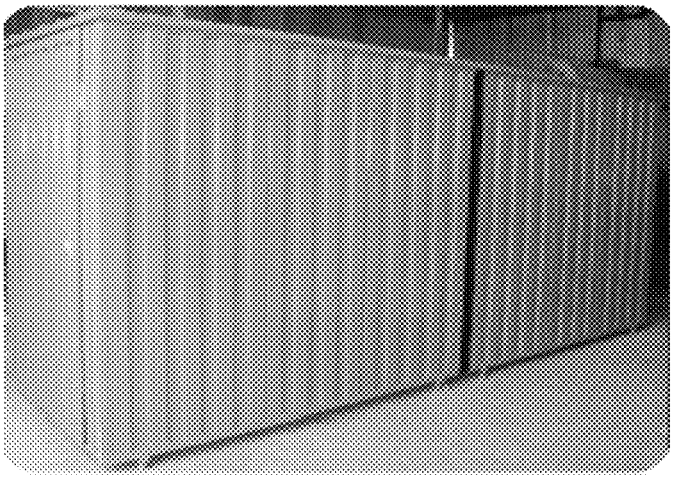
FIG. 9 shows a characterization carried out by the connection crossheads (2) that makes it possible to double the container size, according to a preferred embodiment of the present invention.

There are, preferably, two types of crossheads for straight connections, the 90-degree one (1) for curves and the connection one (2), as shown in FIGS. 1 and 3, respectively. Through a dedicated part, horizontal adjustment is possible to both expand and change the configuration of the arrangement. Basically, the connection crosshead (2) used to expand the basic size is sized L=2.0 m×W=3.0 m×H=2.2 m, as required. An example of doubling the container (3) size using the connection crosshead (2) can be seen in FIG. 9.

Figure 2:
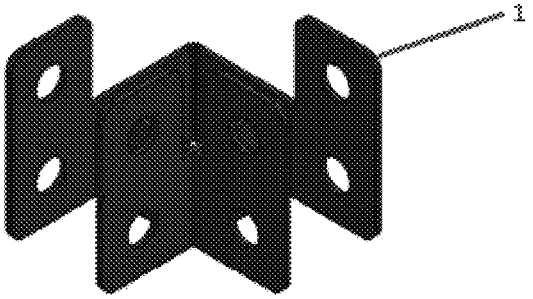
FIG. 2 is a side view perspective of the 90° crosshead (1) of the container, which enables "T", "L" or "U" shaped layouts, for example, according to a preferred embodiment of the present invention.
Figure 10:
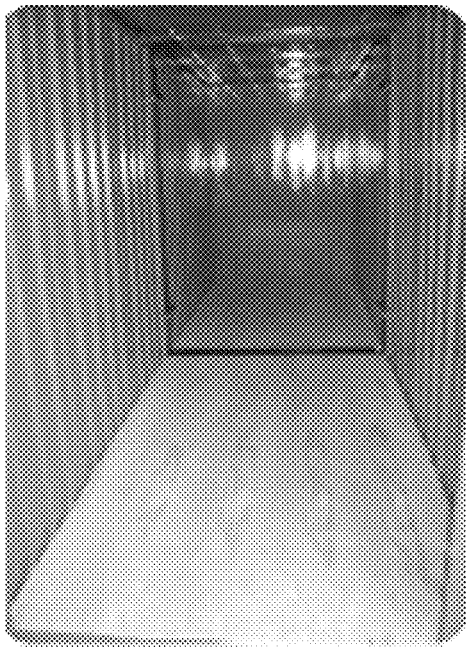
FIG. 10 is an internal view of an arrangement of connection crossheads (2), comprising the increase in size of the container with 90° crossheads (1), which comprise changing the container configuration, according to a preferred embodiment of the present invention.
Figure 11:
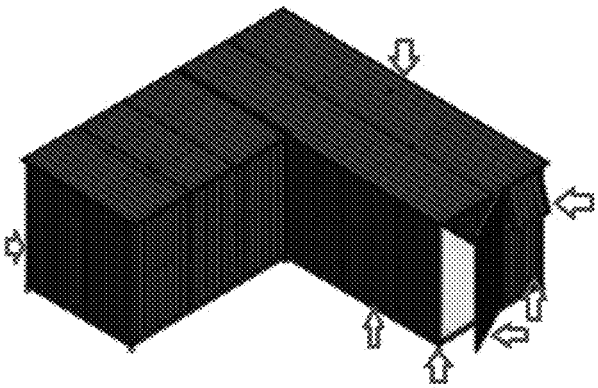
FIG. 11 shows the configuration changed to the "L" shape, which comprises the use of 90° crossheads (1) so that a layout different from the traditional one can be assembled, according to a preferred embodiment of the present invention.

The connection crosshead (2) shown in FIG. 3 is responsible for increasing the container (3) size and the 90° crosshead (1), as shown in FIGS. 1 and 2, is responsible for changing the container configuration (3). The detail of the crossheads arrangement can be better seen in FIG. 10. Basically, one of the advantages of using these crossheads is that the container (3) can be assembled in a different layout than the traditional one, for example, in a "T", "L" or "U" shaped layout. An example of an "L" shaped container configuration using 90 crossheads (1) is seen in FIG. 11.

Figure 12:
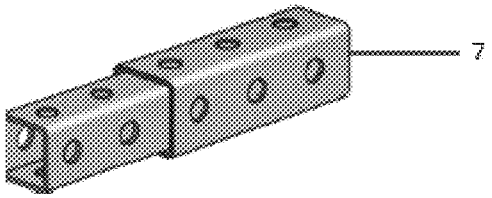
FIG. 12 shows a lifting slide (7) used to enable the vertical adjustment of the container plates, according to a preferred embodiment of the present invention.

Another difference of the container (3) of the present invention is the possibility of easily adjusting its height between 1.80 m and 2.20 m, through a marking system made on the container (3) tubes. To achieve this effect, a system was developed to adjust the side plates of the container (3), so that they adjust to the possible height variations, as seen, for example, on the roof, window and front of the container (3) in FIG. 8. When the need to vary the height of the container plates (3) is detected to facilitate its installation at more complex places with aerial interference, for example, a lifting slide (7) is used, as seen in FIG. 12, to enable the vertical adjustment of the container plates (3).

Generally speaking, as previously discussed, the 90-degree crossheads (1) serve to enable the feature of "L", "T" or "U" configuration; through them the modular plates are fitted and provide the desired arrangement so that the container (3) is adapted to the available layout. As for the connection crossheads (2), they serve to enable the ability to vary the size of a container unit (3), through which the modular plates are fitted and provide the desired increase so that the container (3) is adapted to the greater use of space by avoiding aerial interference from the available layout. There is also a lifting slide (7) that allows variation in height; through this item the modular plates when fitted can vary vertically from 1.8 m to 2.2 m, so that the container (3) can be adapted to the layout available.

Tests were also carried out with about ten disassemble and configurable modular containers (3) which were distributed for responsibility of coordination of maintenance, production, SMS and vessel in the areas of the Topside modules and underneath them on the main deck. Basically, the containers (3) were used by the teams involved to store material, such as collective protection equipment (CPE), tools, hygiene items . . . used in the production, maintenance, safety and cleaning processes.

Among the advantages found is the elimination and/or reduction of unnecessary trips that cause a waste of time, as well as protection against wearing of items not stored in an appropriate location/condition; improvement in the organization and cleaning condition, in addition to the visual aspect of the unit, as it eliminates improvised installations such as structures assembled from scaffolding, thus being both an important contribution to the safety of the unit and the increase in the creation of safe conditions; strengthens and contributes to issues associated with both NR 17 (ergonomics) and NR 37 (health and safety on platforms), as the container (3) is both associated with the concern with improving the conditions of the facilities and also with the reduction of travel/unnecessary movement that promotes fatigue/wear and tear on the employee's physical condition; It also favors the strengthening of the implementation of the 5S culture in the unit, in view of the standardization identity.

The invention claimed is:

1. A disassembled modular shipping container comprising:

a plurality of modular plates;

at least one upper closure plate;

a flooring plate;

a first plurality of crossheads configured to extend a space of the modular shipping container horizontally;

a second plurality of crossheads configured to rearrange a layout configuration of the modular shipping container; and a plurality of slides configured to adjust one or more modular plates the plurality of modular plates.

2. The disassembled modular shipping container according to claim 1, wherein the one or more modular plates of the plurality of modular plates have a basic size of L=2.0M×W=3.0 m×H=2.2 m and a basic weight of 250 kg.

3. The disassembled modular shipping container according to claim 1, wherein:

the plurality of modular plates, the first plurality of crossheads, the second plurality of crossheads, and the plurality of slides forms a structure of manufactured with AISI304 stainless steel and high-resistance steel profiles; and both of the AISI304 stainless steel and high-resistance steel profiles include a 1.5 mm thickness, and chemical treatment against corrosion and weathering;

the at least one upper closure plate including a first a Galvalume steel sheet; and the flooring plate including a second Galvalume steel sheet.

4. The disassembled modular shipping container according to claim 1, further comprising tubes and a marking system made on the tubes to adjust a height of the modular shipping container between 1.80 m and 2.20 m.

5. The disassembled modular shipping container according to claim 1, further comprising a system for adjusting the one or more modular plates of the plurality of modular plates, wherein the container is molded to the layout of an available environment.

6. The disassembled modular shipping container according to claim 1, wherein the at least one of the first plurality of crossheads or the second plurality of crossheads includes a stainless steel (AISI 316) part made using high-resistance laser cutting.

7. The disassembled modular shipping container according to claim 1, wherein each of the plurality of modular plates includes a minimum size of L=1.0M×W=1.50 m×H=2.2 m.

8. The disassembled modular shipping container according to claim 1, wherein the plurality of slides includes a lifting slide configured to provide a vertical adjustment of the one or more modular plates.

9. The disassembled modular shipping container according to claim 1, wherein the second plurality of crossheads is configured to rearrange the layout configuration to "L," "T," "U," or single-piece shapes.

10. A disassembled modular container comprising:

a plurality of modular plates;

at least one upper closure plate including a first Galvalume steel sheet;

a flooring plate including a second Galvalume steel sheet;

a first plurality of crossheads configured to extend a space of the modular horizontally;

a second plurality of crossheads configured to rearrange a layout arrangement of the modular container; and a plurality of slides configured to adjust one or more modular plates of the plurality of modular plates, wherein:

the plurality of modular plates, the first plurality of crossheads, the second plurality of crossheads, and the plurality of slides forms a structure manufactured with AISI304 stainless steel and high-resistance steel profiles; and both of the AISI304 stainless steel and high-resistance steel profiles include a 1.5 mm thickness, and chemical treatment against corrosion and weathering.

11. The disassembled modular container according to claim 10, wherein the one or more modular plates of the plurality of modular plates have a basic size of L=2.0M×W=3.0 m×H=2.2 m and a basic weight of 250 kg.

12. The disassembled modular container according to claim 10, further comprising tubes and a marking system made on the tubes to adjust a height of the modular container between 1.80 m and 2.20 m.

13. The disassembled modular container according to claim 10, further comprising a system for adjusting the one or more modular plates of the plurality of modular plates, wherein the container is molded to the layout of an available environment.

14. The disassembled modular container according to claim 10, wherein the at least one of the first plurality of crossheads or the second plurality of crossheads includes a stainless steel (AISI 316) part made using high-resistance laser cutting.

15. The disassembled modular container according to claim 10, wherein each of the plurality of modular plates includes a minimum size of L=1.0M×W=1.50 m×H=2.2 m.

16. The disassembled modular container according to claim 10, wherein the plurality of modular plates includes a minimum size of L=1.0M×W=1.50 m×H=2.2 m.

17. The disassembled modular container according to claim 10, wherein the second plurality of crossheads is configured to rearrange the layout configuration to "L," "T," "U," or single-piece shapes.

* * * * *